US006390782B1

(12) United States Patent
Booth et al.

(10) Patent No.: US 6,390,782 B1
(45) Date of Patent: May 21, 2002

(54) CONTROL VALVE FOR A VARIABLE DISPLACEMENT COMPRESSOR

(75) Inventors: Steven Brent Booth, Lockport, NY (US); Jay Arthur Ballard, Mapleton; Mark Paul Ballard, Pleasant Grove, both of UT (US)

(73) Assignee: Alumina Micro LLC, Lockport, NY (US)

( * ) Notice: Subject to any disclaimer, the term of this patent is extended or adjusted under 35 U.S.C. 154(b) by 0 days.

(21) Appl. No.: 09/527,142

(22) Filed: Mar. 21, 2000

(51) Int. Cl.[7] ..... F04B 1/26
(52) U.S. Cl. ..... 417/53; 417/222.2
(58) Field of Search ..... 417/222.2, 53

(56) References Cited

U.S. PATENT DOCUMENTS 4,730,986 A * 3/1988 Kayukawa et al. ..... 417/222.2
4,732,544 A * 3/1988 Kurosawa et al. ..... 417/222.2
4,932,843 A 6/1990 Itoigawa et al.
5,588,807 A 12/1996 Kimura et al.
5,620,310 A 4/1997 Takenaka et al.
5,681,150 A * 10/1997 Kawaguchi et al. ..... 417/222.2
5,702,235 A 12/1997 Hirota et al.
5,964,578 A 10/1999 Suitou et al.
5,975,859 A 11/1999 Kawaguchi et al.
6,010,312 A * 1/2000 Suitou et al. ..... 417/222.2
6,126,405 A * 10/2000 Kawaguchi et al. ..... 417/222.2
6,164,925 A * 12/2000 Yokomachi et al. ..... 417/222.2
6,164,926 A * 12/2000 Kawaguchi ..... 417/222.2

FOREIGN PATENT DOCUMENTS

JP 6-330856 11/1994

* cited by examiner

*Primary Examiner*—Cheryl J. Tyler

(57) ABSTRACT

A variable control valve 10 for a gas compression system is disclosed for a gas compressor 100 with a piston 116 having a variable displacement within a compression chamber 114 of the gas compressor. A pressure within a crankcase chamber 118 of the gas compressor acts upon the piston A diaphragm 36 within the control valve, controls a flow of high and low pressure gas into and out of the pressure chamber, thus controlling the displacement of the piston. The diaphragm is acted upon by a predetermined reference pressure within a reference chamber 90 of the control valve. The predetermined reference pressure within the reference chamber is created by a flow into and out of the reference chamber of the high and low pressure gas. The predetermined reference pressure can be changed in order to optimize compressor output. This flow is controlled by reference chamber valve means (88, 86) operably coupled to the reference chamber, the reference chamber valve means being responsive to electrical signals.

20 Claims, 10 Drawing Sheets

74
60
110
18
64
14
58
100
69
62
132
52
50
10
70
56
CRANK
CASE
118
128
14
54
130
42
40
116
44
14
30
12
126
114
37
38
SUC
DISC
68
34
112
32
41
72
124
120
36
43
93
39
CONDENSER
140
94
91
98
EVAPORATOR
142
88
96
81
86
ACCUMULATOR
144
16
92
20
111
90
80
87
85
146
83
84
COMPRESSOR
CONTROL
UNIT
82
89

74
60
110
18
64
14
58
100
69
62
132
52
50
500
70
56
CRANK
CASE
118
128
14
54
130
42
40
116
44
14
30
12
126
114
37
38
68
34
112
SUC
DISC
32
510
72
124
120
36
43
140
93
39
CONDENSER
94
91
142
98
EVAPORATOR
88
96
144
81
86
ACCUMULATOR
16
92
20
111
90
80
87
85
146
83
84
COMPRESSOR
CONTROL
UNIT
82
89

74
60
110
18
64
14
58
109
69
62
132
52
50
CRANK
CASE
600
70
56
128
14
54
118
108
12
116
14
30
620
612
126
114
68
34
SUC
DISC
610
112
124
614
72
120
93
CONDENSER
140
94
91
98
EVAPORATOR
142
88
96
81
86
144
ACCUMULATOR
16
92
20
111
90
80
87
85
146
83
84
COMPRESSOR
CONTROL
UNIT
82
89

74
60
110
18
64
14
58
109
69
62
132
52
50
CRANK CASE
700
70
56
128
14
54
118
108
12
116
30
14
126
114
68
32
34
SUC
DISC
710
112
124
72
120
43
140
93
39
CONDENSER
94
91
142
98
EVAPORATOR
88
96
144
81
86
ACCUMULATOR
16
92
20
111
90
80
87
85
146
83
84
COMPRESSOR CONTROL UNIT
82
89

CONTROL VALVE FOR A VARIABLE DISPLACEMENT COMPRESSOR

BACKGROUND OF THE INVENTION

1. Field of the Invention

The present invention relates to control valves, and in particular, to a control valve for a variable displacement gas compressor for use in an air conditioning or refrigeration system 2. Description of the Related Art A gas compressor will change a state of a gas from a low-pressure state to a high-pressure state. Such a compressor is often used in air-conditioning (A/C) systems where expansion of a refrigerant gas compressed by the compressor causes air passing over evaporator gas tubes to cool. After the gas has expanded, it is recycled through the compressor so to be compressed again.

The refrigerant gas is discharged by the compressor at a high pressure known as the discharge pressure. It moves to a condenser, where the high pressure, high temperature gas condenses into a high pressure, high temperature liquid, the energy required for the state change being transferred to air passing over the condenser fins in the form of heat. From the condenser, the liquid travels through an expansion device, where it expands, to an evaporator where it evaporates. The air passing over the evaporator coils gives off its heat to the refrigerant, providing energy needed for the state change. The cooled air passes out into the compartment to be cooled. The degree to which the air is cooled is proportional to the amount of expansion of the refrigerant gas, and the amount of expansion of the gas is directly proportional to how much gas is compressed within the compressor. The pressure of the gas is controlled within the compressor by the amount of displacement of the piston within the compression chamber.

A key concern in designing a cooling system utilizing refrigerant gas is too ensure that the liquid from the condenser does not flow in a quantity and temperature to push the evaporator below the freezing point of water. If there is too much heat absorption by the gas within the evaporator, the water found on the fins and tubes through condensation of water from air passing over the evaporator will freeze up, choking off air flow over the evaporator, thereby cutting off the flow of cool air to the passenger compartment. For this reason, most conventional control valves are calibrated to change the stroke (displacement) of the compressor based on the pressure of the gas returning to the compressor at a set pressure of the gas. The gas returns to the suction area of the compressor. The pressure in this area of the compressor is known as the suction pressure. The desired suction pressure, around which the stroke of the compressor is changed, is known within the art as the set-point suction pressure.

In 1984, a variable displacement refrigerant compressor was introduced which adjusted the flow of the refrigerant gas through the system by varying the stroke of the piston in the pumping mechanism of the compressor in the manner just described. This system was designed for use in an automobile, deriving power to drive the compressor using a drive belt coupled to the vehicle's engine. In operation, when the A/C system load is low, the piston stroke of the compressor is shortened so that the compressor pumps less refrigerant per revolution of the engine drive belt. This allows just enough refrigerant to satisfy the cooling demands of the automobile's occupants. When the A/C system load is high, the piston stroke is lengthened and pumps more refrigerant per revolution of the engine drive belt.

A description of this prior art variable displacement compressor and a conventional pneumatic control valve (CV) is found in U.S. Pat. No. 4,428,718 by Skinner (Skinner '718) which is assigned to the General Motors Corporation of Detroit, Mich. The Skinner '718 description and explanation of the variable displacement compressor, general function, and interaction of the CV with the compressor is hereby incorporated by reference.

FIG. 9 shows a variable displacement refrigerant compressor as described by Skinner '718. There is shown a variable displacement refrigerant compressor 210 of the variable angle wobble plate type connected in an automotive air conditioning system having the normal condenser 212, orifice tube 214, evaporator 216 and accumulator 218 arranged in that order between the compressor's discharge and suction sides. The compressor 210 comprises a cylinder block 220 having a head 222 and a crankcase 224 sealingly clamped to opposite ends thereof. A drive shaft 226 is supported centrally in the compressor at the cylinder block 220 and crankcase 224 by bearings. The drive shaft 226 extends through the crankcase 224 for connection to an automotive engine (not shown) by an electromagnetic clutch 236 which is mounted on the crankcase 224 and is driven from the engine by a belt 238 engaging a pulley 240 on the clutch 236.

The cylinder block 220 has five axial cylinders 242 through it (only one being shown), which are equally spaced about and away from the axis of drive shaft 226. The cylinders 242 extend parallel to the drive shaft 226 and a piston 244 is mounted for reciprocal sliding movement in each of the cylinders 242. A separate piston rod 248 connects the backside of each piston 244 to a non-rotary, ring-shaped, wobble plate 250.

The non-rotary wobble plate 250 is mounted at its inner diameter 264 on a journal 266 of a rotary drive plate 268. The drive plate 268 is pivotally connected at its journal 266 by a pair of pivot pins (not shown) to a sleeve 276 which is slidably mounted on the drive shaft 226, to permit angulation of the drive plate 268 and wobble plate 250 relative to the drive shaft 226. The drive shaft 226 is drivingly connected to the drive plate 268. The wobble plate 250 while being angularable with the rotary drive plate 268 is prevented firm rotating therewith by a guide pin 270.

The angle of the wobble plate 250 is varied with respect to the axis of the drive shaft 226 between the solid line large angle position shown in FIG. 9, which is full-stroke, to the zero angle phantom-line position shown, which is zero stroke, to thereby infinitely vary the stroke of the pistons and thus the displacement or capacity of the compressor between these extremes. There is provided a split ring return spring 272 which is mounted in a groove on the drive shaft 226 and has one end that is engaged by the sleeve 276 during movement to the zero wobble angle position and is thereby conditioned to initiate return movement.

The working ends of the cylinders 242 are covered by a valve plate assembly 280, which is comprised of a suction valve disk and a discharge valve disk, clamped to the cylinder block 220 between the latter and the head 222. The head 222 is provided with a suction area 282 which is connected through an external port 284 to receive gaseous refrigerant from the accumulator 218 downstream of the evaporator 216. The suction area 282 is open to an intake port 286 in the valve plate assembly 280 at the working end of each of the cylinders 242 where the refrigerant is admitted to the respective cylinders on their suction stroke each through a reed valve formed integral with the suction valve disk at these locations. Then on the compression stroke, a discharge port 288 open to the working end of each cylinder 242 allows the compressed refrigerant to be discharged into a discharge area 290 in the head 222 by a discharge reed valve which is formed integral with the discharge valve disk. The compressor's discharge area 290 is connected to deliver the compressed gaseous refrigerant to the condenser 212 from whence it is delivered through the orifice tube 214 back to the evaporator 216 to complete the refrigerant circuit as shown in FIG.9.

The wobble plate angle and thus compressor displacement can be controlled by controlling the refrigerant gas pressure in the sealed interior 278 of the crankcase behind the pistons 244 relative to the suction pressure. In this type of control, the angle of the wobble plate 250 is determined by a force balance on the pistons 244 wherein a slight elevation of the crankcase-suction pressure differential above a suction pressure control set-point creates a net force on the pistons 244 that results in a turning moment about the wobble plate pivot pins (not shown) that acts to reduce the wobble plate angle and thereby reduce the compressor capacity.

An important element of the variable displacement compressor is a pneumatic control valve 300 inserted into the head portion 222 of the compressor. CV 300 senses the A/C load by sensing the pressure state (the suction pressure) of the refrigerant gas returning to the compressor. The CV is operably connected to the crankcase chamber 278. There are channels in the cylinder block 220 and the head 222 of the compressor for gas flow between the CV and suction area 282, discharge area 290 and crankcase chamber 278 of the compressor. The CV controls the displacement of a piston 244 within the compressor by controlling the pressure of gas in the crankcase chamber 278 that acts on the backside of the pistons 244 and the wobble plate 250.

Control valve 300 inserts into a stepped, blind CV cavity 298 formed in the compressor head 222. The blind end of CV cavity 298 communicates directly with discharge area 290 through port 292. CV cavity ports 294 and 295 communicate with the crankcase chamber 278. CV cavity port 296 communicates with the suction area 282. CV 300 is sealed into the CV cavity 298 so that particular features of the CV align with ports 292, 294, 295 and 296.

FIG. 10 illustrates, in more detail, the pneumatic CV 300 depicted in FIG. 9. The valve 300 comprises a valve body 301 and valve bellows cover 312. Grooves 314, 316 and 318 are formed in the valve body to position o-rings which seal against the walls of the CV cavity 298. A groove 299 formed in the wall of the CV cavity 298 holds an o-ring which seals against the valve bellows cover 312. This arrangement of o-rings seals the valve into four regions within the CV cavity 298 that are sealed with respect to each other and are each in gas communication with one of ports 292, 294, 295 or 296.

CV 300 has an upper valve chamber 330 that communicates to the compressor discharge area 290 via (through) filter 320 and CV cavity port 292. A mid-valve chamber 322 communicates to the crankcase chamber 278 via an opening 321 in the valve body 310. A central passageway 326 in the valve body 310 communicates with the crankcase chamber 278 via port 295. A lower valve chamber 328 communicates with the compressor suction area 282 through opening 327 in the valve bellows cover 312 and via port 296.

CV 300 has a ball valve comprising ball 332 and valve seat 334 that can be operated to control the flow communication path between upper valve chamber 330 and mid-valve chamber 322, hence controlling the flow communication between the discharge area 290 and the crankcase chamber 278 of the compressor. CV 300 has a conical valve consisting of conical member 340 and matching conical valve seat 338 that can be operated to control the flow communication between lower valve chamber 328 and central passageway 326, hence controlling the flow communication between the suction area 282 of the compressor and the crankcase chamber 278.

The conical valve member 340 is formed as a shoulder near one end of a valve rod 336. The other end of valve rod 336 is arranged to push against ball 332 as the conical valve member 340 is seated against the matching conical valve seat 338. With this arrangement, the movement of the valve rod 336 opens and closes the flow communication of both discharge pressure and suction pressure gas to the crankcase chamber 278. The positioning of valve rod 336 can be used to adjust the crankcase pressure to values between suction pressure and discharge pressure. This adjustment of the crankcase pressure, in turn, adjusts the compressor displacement.

In conventional pneumatic CV 300, the position of valve rod 336 is established by a balance of forces arising from the discharge pressure acting on ball 332, a pressure sensitive bellows actuator 350, ball centering spring 354 and bias spring 352. Bellows actuator 350 is comprised of an evacuated metal bellows 342, an internal spring 344, end caps 345 and 346, and bellows stem 348. The bellows actuator 350 is extended by the force of internal spring 344 and is contracted by the force of gas pressure applied to the external surface of the bellows. Bellows actuator 350 is sealed in lower valve chamber 328 that is in gas communication with the suction area 282 of the compressor.

During operation of the compressor, CV 300 responds to changes in the suction pressure of the compressor 210 via the bellows actuator 350, and to changes in the discharge pressure via the force on ball 332. The spring constants and nominal compression of the bellows internal spring 344, bias spring 352 and ball centering spring 354 create forces on valve rod 336 that are set by the valve manufacturer at the time of valve assembly. The spring forces act to normally condition control valve 300 so as to open the flow of discharge pressure gas and simultaneously to close the flow to the suction area 282 from the crankcase chamber 278. CV 300 will therefore control the flow of discharge and suction pressure gasses to the compressor crankcase 278 according to these fixed spring forces.

The nominal spring bias force set-up design parameters in a pneumatic CV such as CV 300 are chosen so that during operation of the air conditioning system, the temperature of the evaporator is maintained slightly above the freezing point of water. The spring bias set-up requires a balancing of system objectives that apply under different air temperature ambient conditions. For higher air temperature ambient conditions, it is optimal to maintain as cold an evaporator as possible without freezing. At lower ambient air temperatures it is desirable to maintain as high an evaporator temperature as can be maintained while still supplying some dehumidification. One choice of spring bias forces for CV 300 must accommodate to multiple ambient air temperature conditions, engine power loading conditions, and user demands for cooling.

Pneumatic CV's with fixed spring force bias set-up designs have two major disadvantages. First, the system is always working at its maximum capacity at the evaporator requiring maximum energy use by the compressor when the cooling system is operating. Second, since the evaporator is always at maximum capacity, hot air must be introduced into the system to temper the cold air to a temperature other than full cold.

An alternate CV design used in variable displacement compressors for vehicle air conditioning system utilizes a solenoid-assisted valve to control the flow of refrigerant gas into the crankcase of a variable displacement compressor. U.S. Pat. No. 5,964,578 by Suitou, et al (Suitou '578), discloses a CV having a solenoid-activated rod that operates on a valve member that controls the flow of discharge and suction pressure gasses to the crankcase. The valve member position is partially established by a spring-biased bellows in similar fashion to a conventional pneumatic CV. Increasing suction pressure acts on the bellows to reduce gas flow from the discharge area to the crankcase. When energized, the solenoid activated rod applies a force that also urges the valve member so as to reduce discharge pressure flow to the crankcase. This allows an additional control of the piston stroke and the output capacity of the compressor that can be mediated by electrical signals to the solenoid coils.

An alternate CV design using a solenoid actuator to assist discharge valve operation has been disclosed in U.S. Pat. No. 5,702,235 by Hirota (Hirota '235). In this design a solenoid is used to open and close a pilot valve that admits discharge pressure gas to a pressurizing chamber in the CV. The pressurizing chamber is in constant gas communication with the suction pressure area of the compressor. A valve member controls the flow of discharge and suction pressure gasses to the crankcase. The position of the valve member is established by a balance of spring bias forces, the force of the discharge pressure acting on an end of the valve member, and the force of the pressure in the pressurizing chamber acting on the opposite end of the valve member. When energized, the solenoid activated pilot valve allows the pressure to rapidly increase in the pressurizing chamber, opening the valve member to increase the flow of discharge pressure gas to the crankcase.

The valve member of the Hirota '235 CV design does not respond to the suction area pressure and does not control compressor displacement according to a suction pressure set-point as does the solenoid-assisted CV of Suitou '578 or the pneumatic CV of Skinner '718. The object of the Hirota '235 CV design is to use the force of discharge pressure gas to open the discharge to crankcase valve, thereby allowing the use of a compact, lightweight and inexpensive solenoid.

There are several major disadvantages with the prior art solenoid-assisted CV's. First, a variable position solenoid is required. Variable position solenoids are not linear in performance and the extreme temperatures in an automobile engine compartment make proper operation of the variable position solenoid highly difficult given power constraints. Second, a large and precise current value is required to properly position the solenoid. Third, variable position solenoid systems do not provide a steady suction pressure set-point whereby the cooling system can maintain itself in a state of equlibrium.

As a solution to the inefficiencies of conventional pneumatic and solenoid-assisted CV's, a CV design is needed in which the set-up of the bias forces acting within a pneumatic valve control valve can be changed to optimize the performance of the cooling system under different conditions. That is, a variable set-point control valve (VCV) is needed which varies the degree of displacement of the piston in the compression chamber. The suction pressure set-point is varied by the VCV according to the temperature desired by the occupants of the passenger compartment. In this manner, the cooling system does not have to operate at its maximum at all times, but rather the compressor only compresses and pumps enough the refrigerant gas to the suction pressure set-point necessary to cool the air flow to the temperature defined by the occupants. Substantial energy is saved by pressurizing the gas only to the point required and pumping only the volume required, and efficiencies are realized by eliminating the introduction of hot air into the cooled air flow.

A variable set-point CV is needed which overcomes the drawbacks of conventional pneumatic and solenoid-assisted CV's and enables a cooling system that maintains a steady-state equilibrium to match the needs of the passengers in the passenger compartment while operating efficiently.

SUMMARY OF THE INVENTION

Accordingly, it is an objective of the present invention to provide a control method and a control valve used in variable displacement compressors, which valve maintains the pressure in the compressor crankcase in response to the suction pressure of the compressor relative to a stable, predetermined set-point of the suction pressure, which set-point can be changed during compressor operation by electrical signals.

To achieve the above objective the present invention discloses a control valve in a variable displacement compressor having a piston having a variable displacement within a compression chamber. A gas is admitted to the compression chamber from a suction area of the compressor at a suction pressure and discharged to a discharge area of the compressor at a discharge pressure. A gas pressure in a crankcase chamber acts upon the piston or mechanical elements linked to the piston, so that the displacement of the piston varies according to the crankcase pressure relative to the suction pressure. The control valve controls the crankcase pressure by means of a discharge valve portion that opens a gas communication path between the discharge area and the crankcase chamber. The discharge valve portion is operably coupled to a pressure sensitive member. The pressure sensitive member has a suction pressure receiving area in gas communication with the suction pressure area and a reference pressure receiving area in gas communication with a reference chamber. The reference chamber has a reference pressure established to a predetermined reference pressure by a flow of discharge and suction pressure gas to and from the reference chamber. The pressure sensitive member moves in response to the predetermined reference pressure and suction pressure changes to open the discharge valve portion. The control valve has reference chamber valve means for controlling the flow of discharge and suction pressure gas to and from the reference chamber in response to electrical signals, thereby establishing the predetermined reference pressure. The control valve of the invention is therefore capable of operating as a variable set-point control valve, wherein a stable set-point can be changed in response to electrical signals.

The present invention also discloses a variable set-point control valve for a variable displacement compressor that additionally controls the flow of suction pressure gas to the crankcase chamber by means of a suction pressure valve portion that opens or closes a gas communication path between the suction area and the crankcase chamber.

The present invention further discloses a method of controlling a variable displacement compressor having a piston having a displacement within a compression chamber, the compression chamber admitting gas at suction pressure and discharging gas at discharge pressure, the displacement of the piston varying according to the compressor crankcase pressure, and a control valve having a gas-filled reference chamber for controlling the crankcase pressure. The method comprises determining an amount of gas to be compressed to cause a condition to occur. A predetermined reference pressure within the reference chamber which will cause a crankcase pressure condition to occur is then determined. The reference pressure within the reference chamber is measured. An amount of discharge pressure gas flow to and suction pressure gas flow to the reference chamber, based on the predetermined reference pressure and the measured reference pressure, is calculated. At least one actuator to operate at least one reference chamber valve to cause the reference pressure to change towards the predetermined reference pressure by allowing the flow of discharge pressure and suction pressure gas into and out of the reference chamber is then actuated. A pressure sensitive member is moved according to the pressure within the reference chamber, the pressure sensitive member opening a gas communication path between the discharge area and the crankcase chamber.

These and other objects, features and advantages of the present invention will become more apparent upon a consideration of the following description and drawings of the preferred embodiments of the present invention, and the claims.

BRIEF DESCRIPTION OF THE DRAWINGS

The invention will be described with reference to the drawings. In the drawings are.

DESCRIPTION OF THE PREFERRED EMBODIMENTS

Figure 1:
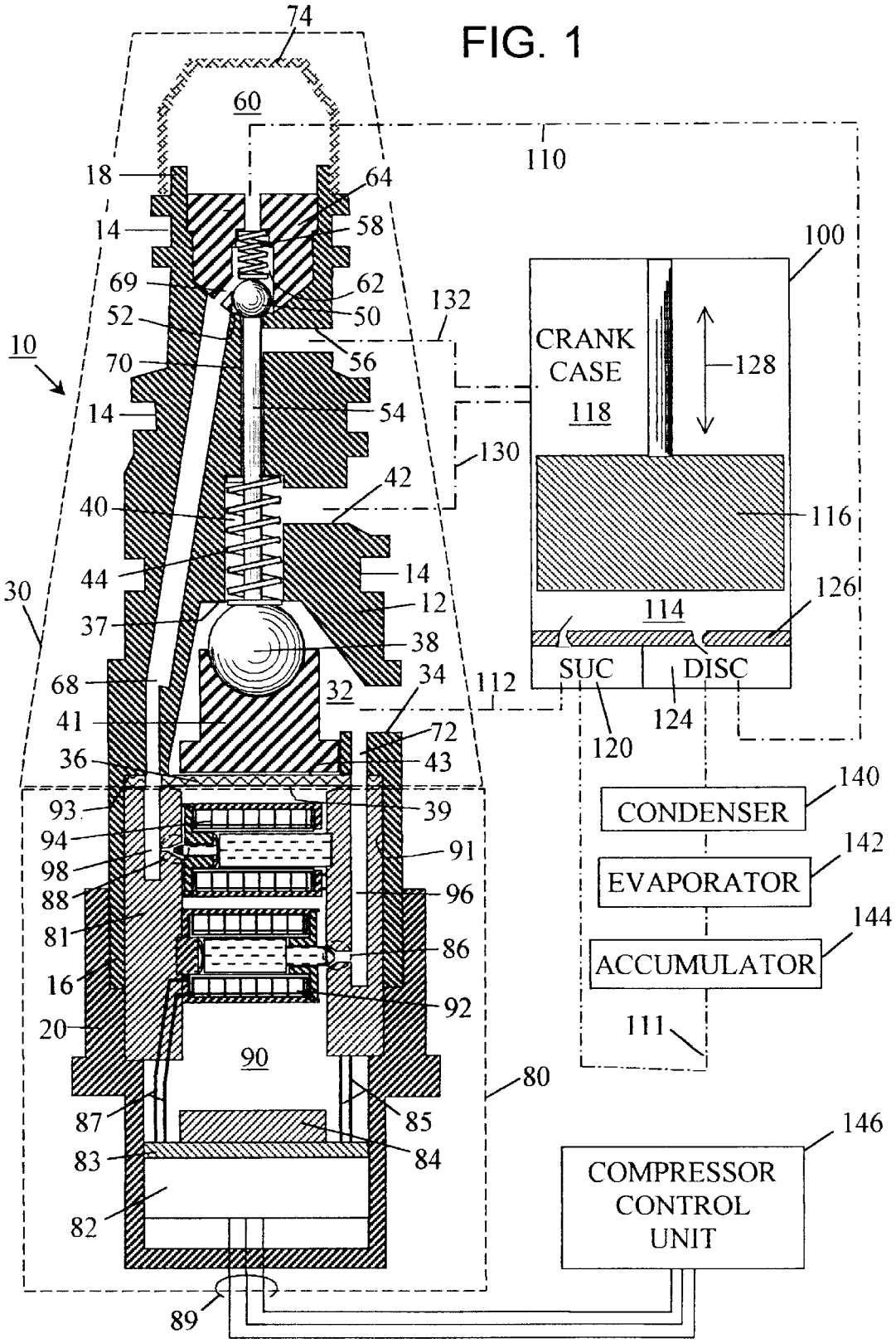
FIG. 1 shows a cross-section of available set point control valve according to a preferred embodiment of the present invention.
Figure 9:
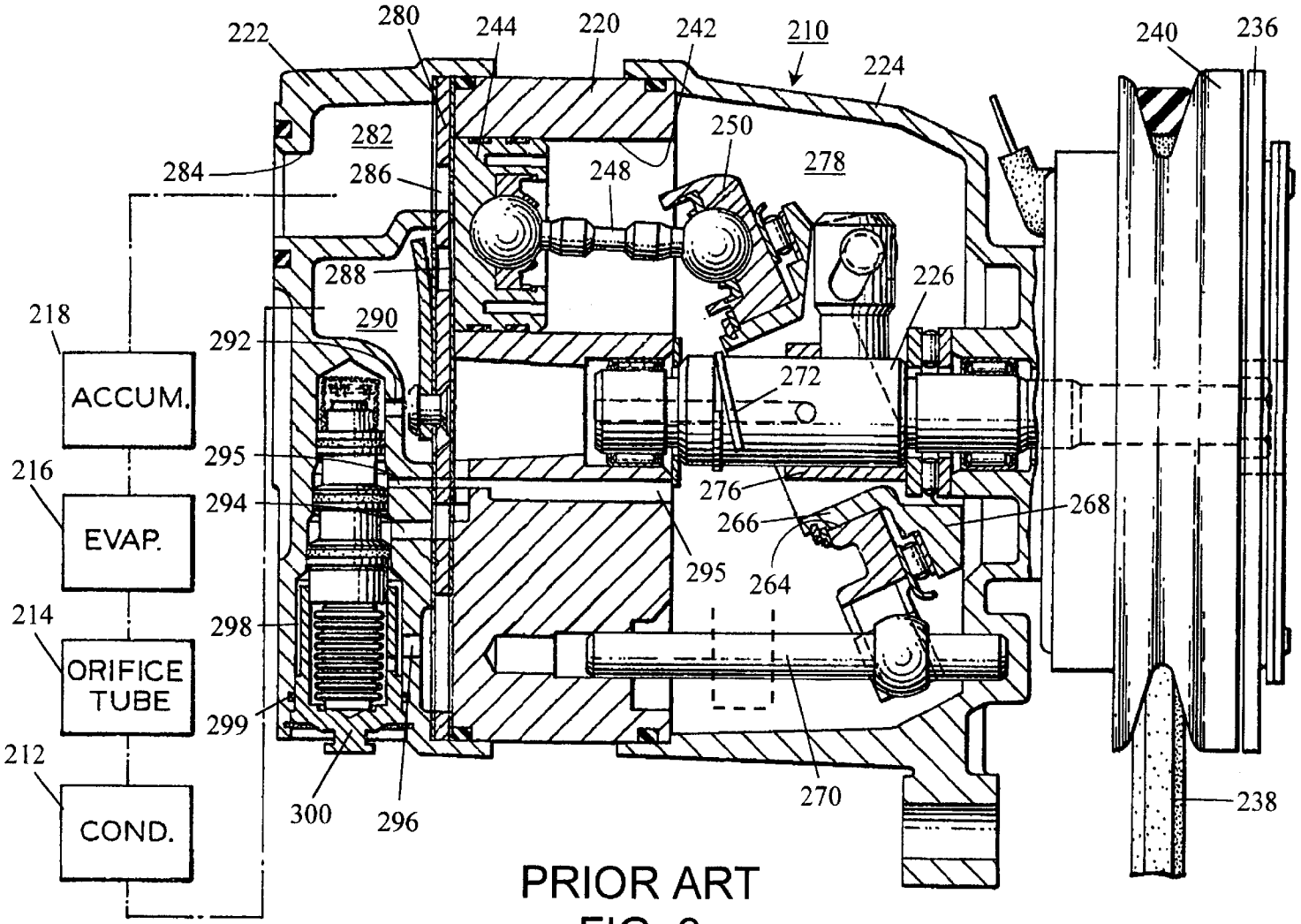
PRIOR ART FIG. 9
FIG. 9 shows a cross-section of a variable displacement compressor for use in an automobile from the prior art.
Figure 10:
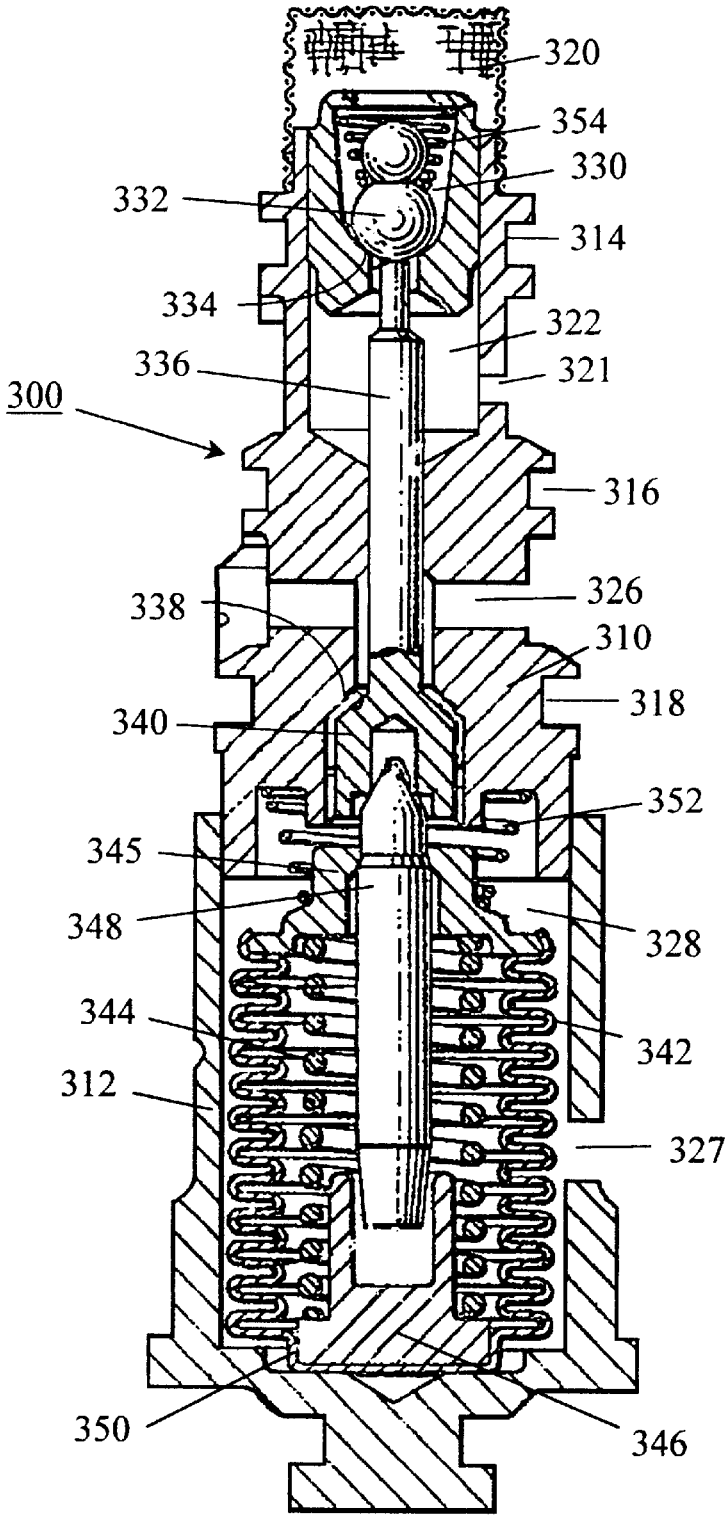
FIG. 10 PRIOR ART
FIG. 10 shows a cross-section of a conventional pneumatic control valve for the variable displacement compressor of FIG. 10 from the prior art.

A variable set point control valve (VCV) 10 is represented in the diagram of FIG. 1 according to a preferred embodiment of the present invention. In FIG. 1, VCV 10 is depicted in cross-sectional view and has a shape and feature placements appropriate to fit the control valve cavity 298 of the Skinner '718 variable displacement compressor described previously (see FIG. 9). VCV 10 is coupled to a compressor 100 which compresses a gas. VCV 10 controls the amount of gas and the degree to which it is pressurized in compressor 100. In the preferred embodiment, the gas compressed in compressor 100 is a refrigerant such as is used in an air conditioning unit. For instance, such an air conditioning unit would be found in an automobile.

VCV 10 comprises a compressor displacement control portion 30 and a variable set point control portion 80. Compressor displacement control portion 30 controls the flow of the gas from compressor 100 in and out of VCV 10 while variable set point control portion 80 controls the operation of compressor displacement control portion 30. VCV valve body 12 is formed with many VCV functional elements which will be described later. In the preferred embodiment illustrated in FIG. 1, valve body 12 is substantially cylindrical in shape as may be inferred from the cross-sectional view shown. O-ring retaining grooves 14 are indicated on the exterior of valve body 12 in three locations. When VCV 10 is inserted into a control valve cavity of a compressor (see for example, FIG. 9), it is assembled with o-ring seals that allow different pressure sources to be communicated to different portions and ports of VCV 10.

Compressor displacement control 30 comprises a suction pressure chamber 32 formed in the lower end 16 of valve body 12 which is in gas communication with the suction area 120 of the compressor 100 through VCV suction port 34 formed in valve body 12 and suction pressure path 112 . Refrigerant circuit line 111 feeds low pressure gas into a compression chamber 114 of compressor 100 via the suction area 120 and a compressor valve plate 126. Refrigerant circuit line 111 is a line returning low pressure refrigerant gas from the accumulator 144 of an air conditioning system Compressor 100 further comprises piston 116, crankcase chamber 118, and discharge area 124. In simple terms, the operation of compressor 100 is as follows. The refrigerant gas in compression chamber 114 is compressed by the stroke of piston 116 as piston 116 moves towards the compressor valve plate 126. The compressor valve plate admits high pressure gas to the discharge area 124. The refrigerant circuit line 111 is connected to the discharge area 124. The greater the displacement (stroke) 128 along compression chamber 114 of piston 116, the greater the pressure and flow volume of the refrigerant gas as it passes through compressor valve plate 126. The refrigerant gas then passes from refrigerant circuit line 111 to a condenser 140 where it condenses to a liquid in the condenser coils. The liquid then flows to an evaporator 142, where the liquid expands at an orifice within the evaporator 142, and evaporates. The air passing over the coils gives off heat energy that provides the energy for the state change from liquid to gas The cooled air is then blown into the passenger cabin of the automobile, or into whatever chamber the air conditioning system is required to cool. After expanding, the refrigerant gas is in a low pressure state and is returned to compressor 100 through the refrigerant circuit line 111.

Compressor 100 is a variable compressor, meaning that the stroke of piston 116 varies dependent upon the required air conditioning system load. For instance, if a user requires additional cooling of the air passing over the evaporator coils, the flow volume of the refrigerant discharged into refrigerant circuit line 111 is increased. The stroke 128 of piston 116 is increased to increase the flow volume.

A pressure is applied within crankcase chamber 118 to the back of piston 116. The greater the pressure within crankcase chamber 118, relative to the suction pressure, the shorter the return stroke 128 of piston 116 after compression due to the high pressure force exerted against piston 116 on the return (away from valve plate 126). Conversely, the lower the pressure within crankcase chamber 118, relative to the suction pressure, the greater the return stroke of piston 116 after compression due to the low pressure force exerted against piston 116. By varying the pressure within crankcase chamber 118, thus varying the displacement 128 of piston 116 and ultimately the pressure of the discharge through refrigerant circuit line 111, the temperature of the air from the evaporator is controlled.

The compressor displacement control portion 30 has a middle chamber 40 formed as a bore centered in valve body 12 leading from suction pressure chamber 32. A first middle port 42 is formed in valve body 12 and communicates with middle chamber 40. First middle port 42 is in gas communication with the crankcase chamber 118 through a first crankcase pressure path 130. VCV 10 further comprises a pressure sensitive member, diaphragm 36, exposed to suction pressure chamber 32. A suction pressure valve, comprising a suction valve closing member, suction valve ball 38, and a suction valve seat 37 formed in valve body 12, is provided to open and close a gas communication path between the suction pressure chamber 32 and the middle chamber 40.

Suction valve ball 38 is urged against suction valve seat 37 by rigid member 41, which is in floating contact with diaphragm 36. A bias spring 44, retained in middle chamber 40, urges suction valve ball 38 off suction valve seat 37, that is, urges the suction valve portion to open. It is also seen that the bias spring 44 opposes a movement of the diaphragm towards the suction valve seat and so acts as an equivalent pressure, a spring bias pressure, adding to the action of the suction pressure on the pressure receiving area of diaphragm 36. The VCV suction pressure valve opens and closes a gas communication path between the suction area 120 and the crankcase chamber 118 of compressor 100.

A discharge pressure valve portion of VCV 10 is comprised of a discharge valve member, discharge valve ball 50, and discharge valve seat 52 formed in valve body 12. Discharge valve ball 50 is positioned in a discharge pressure chamber 60 formed in an upper end 18 of valve body 12. Valve insert 64 has a stepped throughbore 62 that positions discharge valve ball 50 in alignment with discharge valve seat 52. A ball centering spring 58 may be used to further condition the nominal position of discharge valve ball 50. A particle filter cap 74 sealably covers the end of valve body 12, completing discharge pressure chamber 60. When VCV 10 is inserted into the compressor 100, the upper end 18 of the valve body is sealed in a blind end of a control valve cavity such as cavity 298 illustrated in FIG. 9. Discharge pressure path 110 from the discharge area 124 of the compressor is communicated to the blind end of the control valve cavity. Discharge pressure gas is thereby communicated to the VCV discharge pressure chamber 60 through filter 74.

VCV 10 has a central stepped bore 70 through valve body 12. Central bore 70 has a large diameter bore portion at the upper end adjacent the discharge chamber 60 whereat discharge valve seat 52 is formed. Central bore 70 and middle chamber 40 are aligned with each other. A second middle port 56 is formed in valve body 12 and communicates with the large bore portion of central bore 70. Second middle port 56 is in gas communication with the crankcase chamber 118 through second crankcase pressure path 132. When discharge valve ball 50 is moved off discharge valve seat 52, discharge pressure gas can flow through bore 70 to second middle port 56 and then to the crankcase chamber 118 via second crankcase pressure path 132.

A valve rod 54, inserted in central bore 70 partially links the actions of the suction valve portion and the discharge valve portions of the VCV. Valve rod 54 has a diameter slightly smaller than the small bore portion of central bore 70. Valve rod 54 freely slides in central bore 70 yet substantially blocks gas communication between middle chamber 40 and discharge chamber 60. The length of valve rod 54 is chosen so that it simultaneously touches seated discharge valve ball 50 and suction valve ball 38 in a fully open (fully unseated) position. This arrangement links the suction and discharge valve portions in a partial open-close relationship. As suction valve ball 38 moves in a valve-closing direction, valve rod 54 pushes discharge ball 50 in a valve-opening direction. As discharge valve ball 50 moves in a valve closing direction, valve rod 54 pushes suction ball 38 in a valve-opening direction.

In the preferred embodiment of FIG. 1, valve rod 54 is not attached to either valve closing ball. Valve rod 54 operates to open either the discharge or the suction valve portions of the VCV but not to close either. The forces which act to close the discharge valve portion are the pressure of the discharge gas on an effective pressure receiving area of discharge valve ball 50 and a small spring force imparted by ball centering spring 58. The force that acts to close the suction pressure valve portion derives from a movement of pressure sensitive diaphragm 36 via rigid member 41. Other embodiments of the invention in which both valve closing members are attached to a coupling means such as valve rod 54 will be apparent to those skilled in the control valve art. If both valve members are rigidly linked, then a full open-close relationship will exist.

Reference is made specifically now to the variable set point control portion 80 of VCV 10. Variable set point control 80 comprises a closed reference chamber 90 bounded by VCV diaphragm 36, walls 91 formed at the lower end 16 of valve body 12 when the suction pressure chamber 32 was formed, and valve end cap 20. Diaphragm 36 is positioned and sealed against an interior step 93 in the suction pressure chamber 32 by a reference valve carrier 81. The diaphragm 36 has a first side 43 with a suction pressure receiving area exposed to suction pressure in suction pressure chamber 32 and a second side 39 with a reference pressure receiving area exposed to the reference pressure in the reference chamber. Diaphragm 36 is arranged to seal the reference chamber 90 from direct gas communication with the suction pressure chamber 32, the discharge pressure chamber 60, middle chamber 40 or central bore 70.

Two pressure bleed passageways, a discharge bleed passageway 68 and a suction bleed passageway 72 are provided in valve body 12 and align with two holes in the diaphragm 36 that is sealed against valve body interior step 93. Valve insert 64 has a valve insert bleed hole 69 provided to communicate discharge chamber 60 with discharge bleed passageway 68. The bleed passageways, valve insert bleed hole, and corresponding diaphragm holes, provide a source of suction pressure gas and discharge pressure gas to the reference chamber 90. The feature depicted of supplying the discharge pressure gas to the reference chamber from VCV discharge pressure chamber 60 is important because this design uses filter 74 to protect the components and passages in reference chamber 90 from foreign material.

Figure 2:
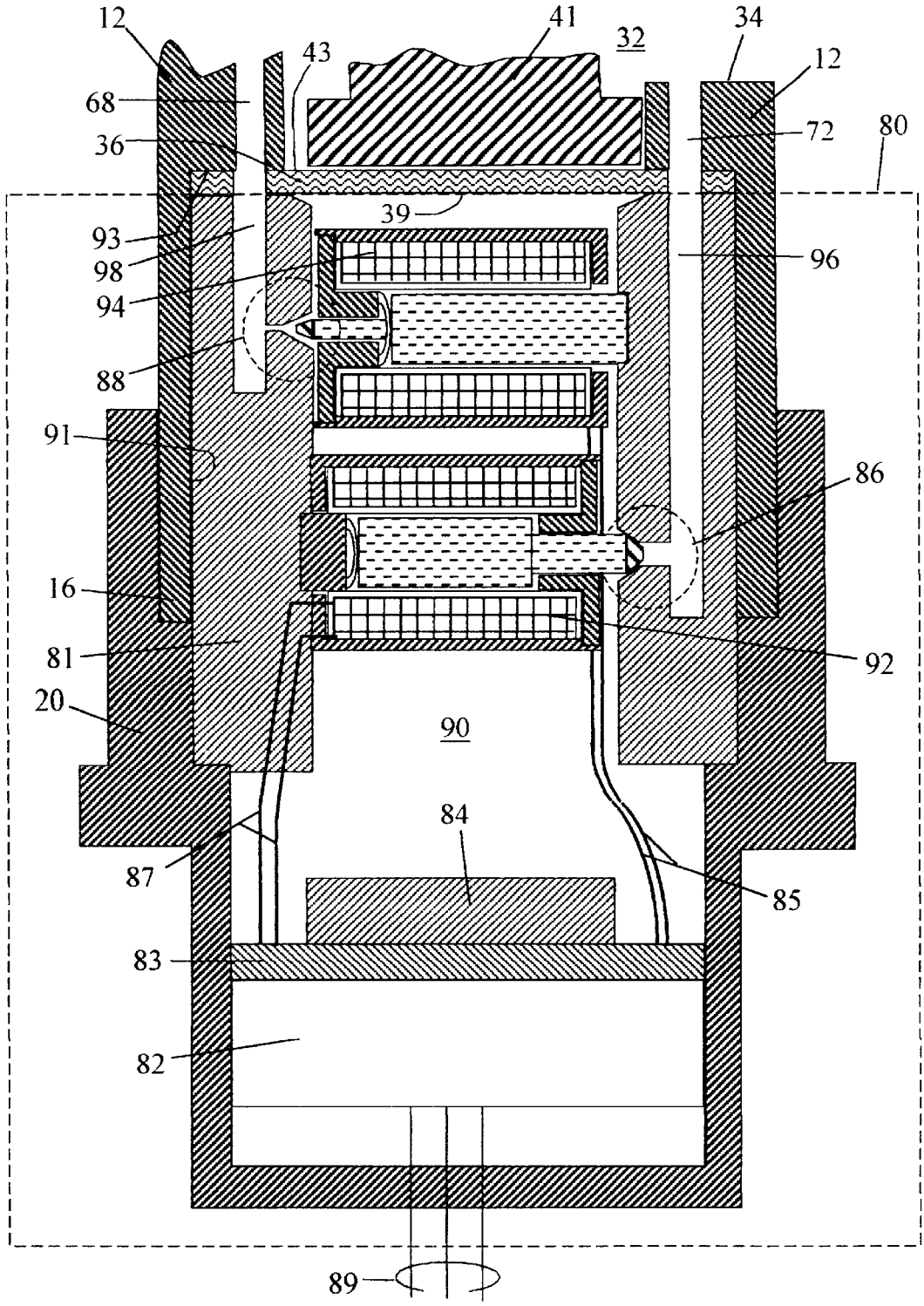
FIG. 2 shows a cross-section of the variable set point control portion of the variable control valve of FIG. 1.

The VCV components contained in the reference chamber are illustrated more clearly in FIG. 2. Reference chamber valve means are further illustrated at higher detail level in FIG. 3. Same elements in FIGS. 1–3 are labeled with the same numbers.

Figure 3:
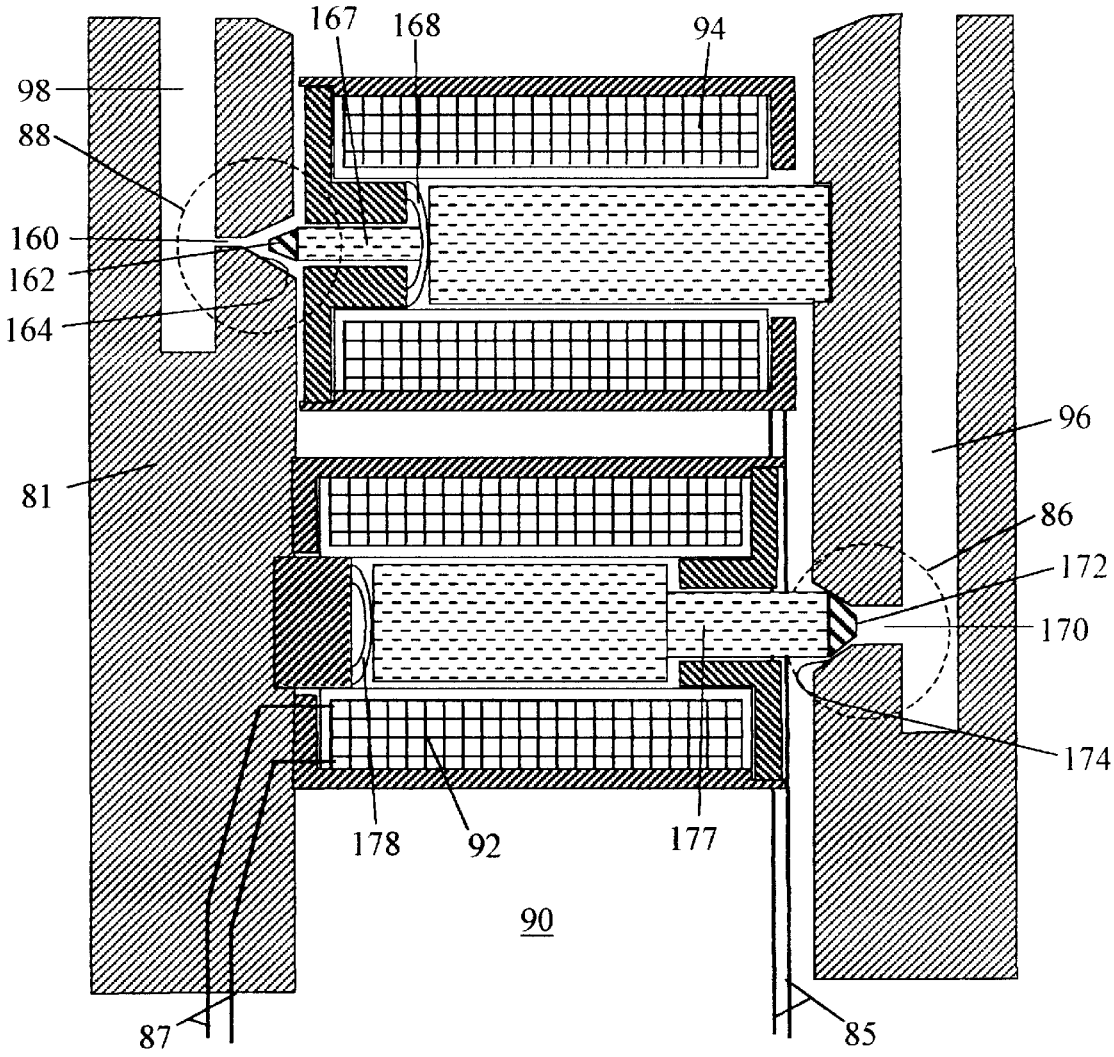
FIG. 3 shows a cross-section of the reference chamber valve means of the variable control valve of FIGS. 1 and 2.

Referring now to FIGS. 1–3, the reference valve carrier 81 is formed as a thick-walled cylinder with outside walls that sealably fit against the interior of walls 91 formed at the lower end 16 of valve body 12. The upper end of reference valve carrier 81 seals against diaphragm 36. Two small blind chambers, a suction bleed chamber 96 and a discharge bleed chamber 98 are formed in the reference valve carrier 81 from the upper end that is sealed against the diaphragm 36. The open end of suction bleed chamber 96 aligns with suction bleed passageway 72 and the open end of discharge bleed chamber 98 aligns with discharge bleed passageway 68. Reference chamber valve means are generally indicated as reference inlet valve 88 and reference outlet valve 86.

Turning to FIG. 3, reference inlet valve 88 is comprised of reference inlet valve closing member 162, reference inlet through hole 160, and reference inlet valve seat 164. Reference inlet through hole 160 is formed from an interior surface of the cylindrical reference valve carrier 81 through to discharge bleed chamber 98. Reference inlet valve seat 164 is formed around the inlet through hole 160 where it emerges from reference valve carrier 81, that is into reference chamber 90. The reference inlet valve closing member 162 is attached to an inlet valve push rod 167 which is part of inlet solenoid actuator 94. When an electrical current signal is applied to inlet solenoid leads 85, inlet valve push rod 167 is pulled into the center of solenoid actuator 94, urging reference inlet valve closing member 162 against reference inlet valve seat 164, closing off reference inlet through hole 160. Reference inlet through hole 160 communicates reference chamber 90 with discharge bleed chamber 98. Thus, opening and closing reference inlet valve 88 by means of electrical signals applied to inlet solenoid actuator 94 controls the flow of discharge pressure gas to the reference chamber.

Inlet solenoid leaf spring 168 is arranged to bias inlet valve push rod in a retracted position as is illustrated in FIG. 3. This inlet solenoid spring bias configuration means that the reference inlet valve 88 will open the reference chamber to the flow of discharge pressure gas in the absence of an electrical signal to energize the coil of the inlet solenoid actuator 94. The depicted reference inlet valve is said to be normally open The opposite arrangement of spring biasing the reference inlet valve to a normally closed condition is an alternate configuration of the reference inlet valve means that may also be employed successfully in another embodiment of the present invention.

Reference outlet valve 86 is comprised of reference outlet valve closing member 172, reference outlet through hole 170, and reference outlet valve seat 174.

Reference outlet through hole 170 is formed from an interior surface of the cylindrical reference valve carrier 81 through to suction bleed chamber 96. Reference outlet valve seat 174 is formed around the outlet through hole 170 where it emerges from reference valve carrier 81, that is into reference chamber 90. The reference outlet valve closing member 172 is attached to an outlet valve push rod 177 which is part of outlet solenoid actuator 92. When an electrical current signal is applied to outlet solenoid leads 87, outlet valve push rod 177 is pulled into the center of solenoid actuator 92, pulling reference outlet valve closing member 172 away from reference outlet valve seat 174, opening reference outlet through hole 170. Reference outlet through hole communicates the reference chamber 90 with suction bleed chamber 96. Thus, opening and closing reference outlet valve 86 by means of electrical signals applied to outlet solenoid actuator 92 controls the flow of suction pressure gas to the reference chamber.

Outlet solenoid leaf spring 178 is arranged to bias outlet valve push rod in an extended position as is illustrated in FIG. 3. This outlet solenoid spring bias configuration means that the reference outlet valve 86 will close the reference chamber to the flow of suction pressure gas in the absence of an electrical signal to energize the coil of the outlet solenoid actuator 92. The depicted reference outlet valve is therefore normally closed. The opposite arrangement of spring biasing the reference outlet valve to a normally open condition is an alternate configuration of the reference outlet valve means that may also be employed successfully in another embodiment of the present invention It should also be appreciated that, while solenoid actuators are discussed herein and depicted in FIGS. 1–3, any electrically-driven physical actuator means could be employed to open and close reference inlet valve 88 and reference outlet valve 86.

The variable set point control portion 80 further comprises an electronic control unit 82, pressure sensor 84, electrical circuit carrier 83, and VCV electrical leads 89. Pressure sensor 84 is an optional feature of the preferred embodiment of the present invention. It is a transducer device that produces an electrical signal that is related to a gas pressure impinging on its sensitive and Pressure sensor 84 is mounted on electrical circuit carrier 83 so as to respond to the gas pressure within closed reference chamber 90. It is not necessary for the practice of the present invention that pressure sensor 84 be mounted directly in the interior of reference chamber 90. An alternative embodiment could mount the pressure sensor at some other position as long as the pressure sensitive portion of the sensor is brought into gas communication with the reference chamber 90.

Electronic control unit 82 is an optional feature of the preferred embodiment of the present invention. Control unit 82 may contain electronic circuitry to control the reference chamber valve means or to receive and process the electrical signals produced by the pressure sensor 84. In a preferred embodiment of this optional feature of the present invention, the electrical components of control unit 82 are co-located with pressure sensor 84 by means electrical circuit carrier 83. Other functions of optional control unit 82 will be described later.

VCV electrical leads 89 are routed from electrical circuit carrier 83 through a sealed opening in valve end cap 20. The number of electrical leads needed by VCV 10 will depend on the functions performed by optional electronic control unit 82 and the device characteristics of optional pressure sensor 84. When neither electrical control unit 82 nor reference chamber pressure sensor 84 are employed, then VCV electrical leads 89 need comprise only those needed to carry electrical signals to activate the reference chamber valve means.

Variable set point control portion 80 controls the operation of compressor displacement control portion 30. By controlling a pressure within reference chamber 90, variable set point control 80 is able to regulate the open/close conditions of the suction pressure valve portion and the discharge pressure valve portion of VCV 10. For instance, if the pressure in reference chamber 90 exerts a force against diaphragm 36 which is less than the force exerted by the pressure in suction pressure chamber 32 and bias spring 44, diaphragm 36 will distort into reference chamber 90, that is in the direction of reference inlet let actuator 94. This motion moves suction valve ball 38 from suction valve seat 37, thus opening the flow of gas from first crankcase pressure path 130 to suction pressure chamber 32. At the same time, the discharge pressure valve portion is closed by the pressure of discharge gas forcing discharge valve ball 50 onto discharge valve seat 52. By opening the flow through the suction valve portion of VCV 10, gas from crankcase chamber 118 will flow into suction pressure chamber 32 and out to the suction area 120 of compressor 100 via suction pressure path 112. With the bleeding of gas out of crankcase chamber 118, less force is exerted on piston 116 giving piston 116 greater displacement. The flow of refrigerant gas flowing into the evaporator of the system is thus increased.

If the pressure in reference chamber 90 exerts a force against diaphragm 36 which is greater than the force exerted by the pressure in suction pressure chamber 32 and bias spring 44, diaphragm 36 will distort into the suction pressure chamber 32, that is, in the direction of suction valve seat 37. This action closes the VCV suction valve portion and, at the same time, opens the VCV discharge valve portion by pushing discharge valve ball 50 away from discharge valve seat 52 by means of valve rod 54. As the discharge valve portion is opened, high pressure gas from discharge pressure path 110 flows through discharge pressure chamber 60, stepped central bore 70, second middle port 56 and second crankcase pressure path 132 to crankcase chamber 118. Pressure will build up in crankcase chamber 118, thus applying a force against piston 116. The displacement 128 of piston 116 is thus restricted and the amount of refrigerant gas passing into the evaporator of the system is reduced.

The force that bias spring 44 exerts on the diaphragm is an important design variable for the overall performance of VCV 10. It has been found through experimentation that it is most beneficial if the spring force is adjusted to be equivalent to from 2 to 20 psi of suction pressure, and most preferably, from 4 to 10 psi. This range of spring bias force allows for sufficient operational range of VCV 10 in the condition of very low compressor capacity usage, that is, when the compressor is near full de-stroke operation.

The pressure within reference chamber 90 is controlled by the opening and closing of reference outlet valve 86 and reference inlet valve 88. Each of these are optionally controlled, in the preferred embodiment, by pressure sensor 84 and electronic control unit 82. Specifically, the pressure within reference chamber 90 is in gas communication with pressure sensor 84. Pressure sensor 84, interfaced to electronic control unit 82, measures the pressure of the gas in reference chamber 90 and communicates that pressure to electronic control unit 82. Electronic control unit 82 receives control signals and information from a compressor control unit 146. Passenger comfort level settings and other information about environmental conditions and vehicle operation conditions are received by compressor control unit 146. Compressor control unit 146 uses stored compressor performance algorithms to calculate a necessary amount of gas to be compressed within the compression chamber 114 by piston 116 to cause a desired condition to occur, namely that the passenger comfort level settings are optimally achieved within the constraints imposed by environmental and vehicle operational factors.

The calculated compressor displacement requirements, the pressure information from pressure sensor 84, and known physical response characteristics of VCV 10 elements are utilized by VCV performance algorithms to calculate a necessary pressure within reference chamber 90 to meet the compressor displacement requirements. This calculated reference pressure, necessary to meet the requirements determined by the compressor control unit, is called a predetermined reference pressure. The variable displacement compressor 100 is thereby controlled by the determining of the predetermined reference pressure and the maintenance of the gas pressure in the reference chamber to this predetermined pressure level Alternatively, if a pressure sensor 84 is not employed, the predetermined reference pressure may be selected from a stored set of reference pressure levels that has been pre-calculated based on the known nominal characteristics of VCV 10 or, in addition, customized for each VCV by means of a calibration set-up procedure. In the case of this alternate embodiment of the present invention, the calculated compressor displacement requirements are used to determine, in look-up table fashion, the predetermined reference pressure that is optimal for achieving the desired compressor displacement control.

Control of reference outlet valve 86 and reference inlet valve 88 comes from electronic control unit 82 through actuators 92 and 94, respectively. Dependent upon the outputs of the algorithms within electronic control unit 82, electronic control unit 82 will open and close reference outlet valve 86 by actuating outlet actuator 92 and open and close reference inlet valve 88 by inlet actuator 94. For instance, when the pressure within reference chamber 90 is to be increased, inlet actuator 94 will retract reference inlet valve member 162 allowing high pressure gas to flow from discharge pressure chamber 60 through valve insert bleed hole 69, discharge pressure bleed passageway 68 and discharge bleed chamber 98 into reference chamber 90. At the same time, outlet actuator 92 closes reference outlet valve 86, thus allowing the pressure in reference chamber 90 to increase. Inversely, to decrease the pressure in reference chamber 90, electronic control unit 82 will actuate outlet actuator 92 to retract reference outlet valve member 172 to open flow from reference chamber 90 through suction bleed chamber 96 to suction pressure bleed passage 76 to suction pressure chamber 32, thereby bleeding off pressure. At the same time, actuator 94 is signaled by electronic control unit 82 to extend reference inlet valve member 162 to close off discharge pressure flow into reference chamber 90.

By controlling the pressure within reference chamber 90 to the predetermined reference pressure, electronic control unit 82, through actuators 170 and 172, controls the deflection of diaphragm 36, thus controlling the varying of displacement 128 of piston 116. For the preferred embodiment depicted in FIGS. 1–3, the reference chamber pressure can be continuously or periodically monitored by means of pressure sensor 84. This pressure information can be used as a feedback signal by control unit 82 in a pressure servo control algorithm to maintain the reference chamber at the predetermined reference pressure within chosen error boundaries.

It is anticipated that an important benefit of the VCV design disclosed herein is the ability to maintain valve control performance by tightly maintaining the predetermined reference pressure. The disclosed design also enables the system to electronically change the predetermined reference pressure to a different value, thereby changing the suction pressure set-point about which the variable displacement compressor operates. This allows the vehicle to adjust the compressor control in the face of changing environmental factors to achieve a desired balance of passenger comfort and vehicle performance. In order to realize these benefits to the fullest, the control of the pressure in the reference chamber must be sufficiently responsive.

The responsiveness of the reference pressure control system depends in part on the characteristics of the flow of discharge pressure gas through inlet valve 88 and the flow out of outlet valve 86 to suction pressure. FIG. 4 illustrates some important geometrical feature details of reference inlet valve 88 and reference outlet valve 86.

Figure 4A:
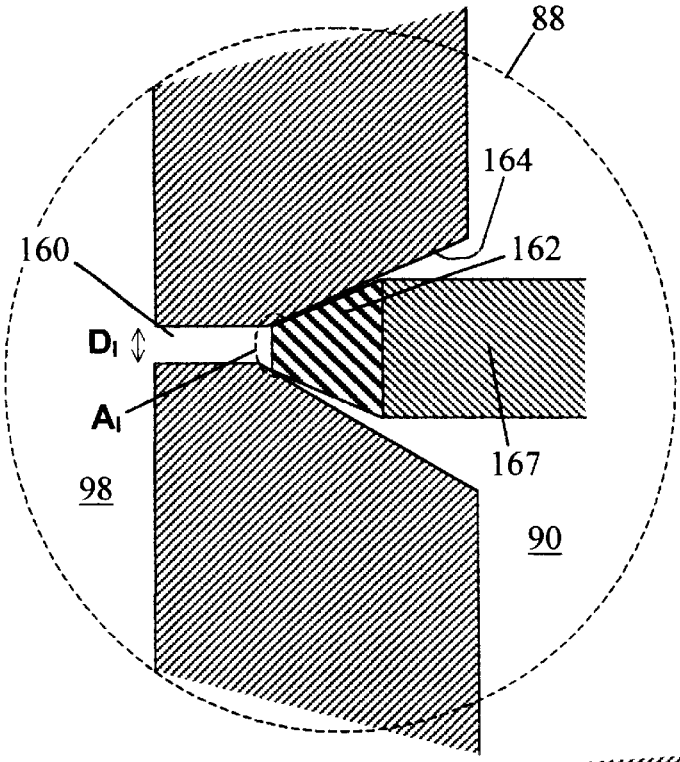
FIG. 4 shows a cross-section of the valve members and valve seats of the reference chamber valve means of the variable control valve of FIGS. 1–3.

Referring first to FIG. 4A, inlet valve closing member 162 is illustrated in a fully closed position holding off the force of discharge pressure gas impinging an effective pressure receiving area, $A_I$, on inlet valve member 162. Also indicated in FIG. 4A is the diameter, $D_I$, of the reference inlet port 160 leading from the discharge bleed chamber 98. A large value of $D_I$ will promote quick response to commands to increase reference chamber pressure by admitting a large flow of discharge pressure. The size of $D_I$ needed to achieve a given reference chamber pressure rise time will depend on the reference chamber gas volume. A larger reference inlet port 160 will be required for a larger reference chamber gas volume to achieve the same increase in reference chamber pressure rise time as for a smaller reference chamber gas volume.

However, a large value of $D_I$ necessitates a correspondingly large value of $A_I$, the effective inlet valve member pressure receiving area This, in turn, would mean that the closing force that would be needed from the inlet valve actuator 94 would also be large. A large closing force might require a physically large actuator or require excessive power to maintain the inlet valve in a closed state. Consequently, the choice of the reference inlet port 160 diameter, $D_I$, and the pressure receiving area, $A_I$, involves a balance of competing requirements.

The effective inlet valve member pressure receiving area, $A_I$, is the net, unbalanced, area of the inlet valve closing member that is exposed to the discharge pressure when the inlet valve is fully closed. That is, the area that effectively receives the force of the discharge pressure, $A_I$, may be calculated by measuring the force exerted on the inlet valve closing member by the discharge pressure, and dividing by the discharge pressure. It has been found through experimentation effective inlet valve pressure receiving area, $A_I$, may be beneficially chosen to be less than 30,000 square microns and preferably, less than 7500 square microns when the reference chamber gas volume is approximately 2 $cm^3$. Under typical automotive air conditioner compressor operating conditions, a reference inlet valve closing force of less than 1 Lb. will suffice if the effective inlet valve member pressure receiving area, $A_I$, is less than approximately 7500 square microns.

Figure 4B:
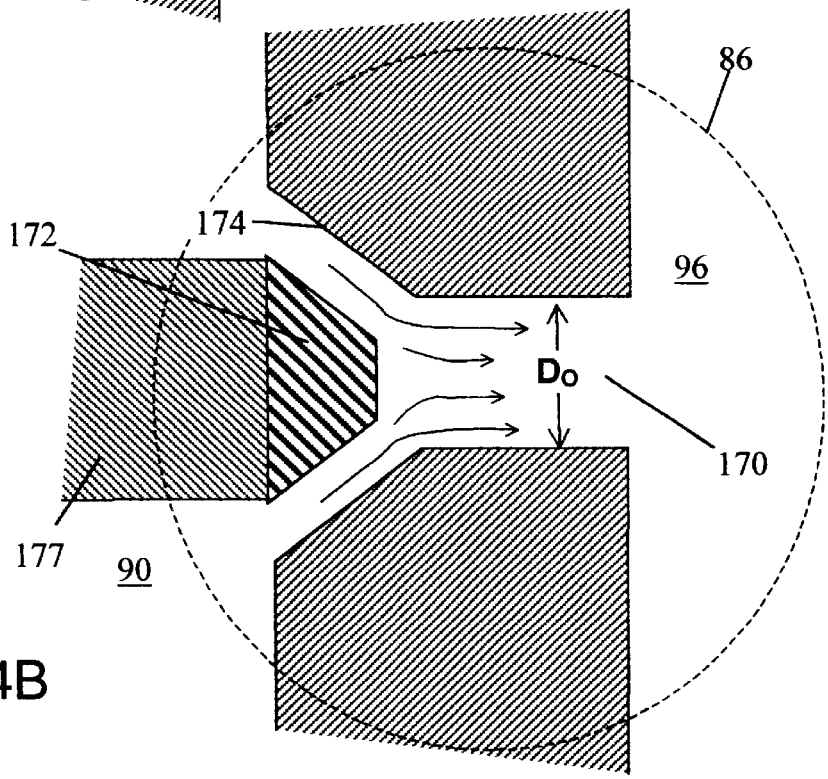

Referring to FIG. 4B, outlet valve closing member 172 is illustrated in a fully open position with gas flowing out of reference chamber 90 through an effective gas flow area Many geometrical designs of the reference outlet port 170 may be chosen to have the same result in terms of the gas volume flow for a given pressure differential between reference chamber 90 and the suction bleed chamber 96. The effective flow area is chosen to balance competing performance characteristics. In order to insure quick response to a command to lower the reference chamber pressure, it is desirable to have a large outlet valve 86 effective flow area On the other hand, to help restrain rapid pressure increases in the reference chamber when opening the inlet valve 88 to discharge pressure, and to bring down reference pressure overshoots that may occur, it is helpful to have a small outlet valve 86 effective flow area The effective gas flow area of the reference outlet valve 86 may be beneficially chosen as a ratio to the effective flow area of the inlet valve 88. Alternatively, the diameter, $D_O$, of the reference outlet port 170, may be chosen as a ratio of the reference inlet port 160 diameter, $D_I$. It has been determined by experimentation and analysis that the beneficial range of the ratio $D_O$ to $D_I$ is from 0.5 to 5.0, and, most preferably, from 0.7 to 2.0. The corresponding beneficial ratio of inlet-port to outlet-port cross-sectional areas, the inlet-to-outlet port areal ratio, is 0.25 to 25.0, and, most preferably, 0.5 to 4.0. When the geometries of inlet and outlet gas flow areas are more complex than the circular passageways illustrated in FIG. 4, the gas flow cross-sectional areas may be analyzed or experimentally determined and the inlet-to-outlet port areal ratio design guideline followed.

It has been found through experimentation, for example, that when the reference chamber 90 gas volume is approximately 2 $cm^3$, a reference outlet port 170 diameter $D_O$ of 100 microns is an effective choice when the reference inlet port 160 diameter $D_I$ is 100 microns, a reference outlet port diameter to reference inlet port diameter ratio of 1.0. With these parameter values, and under typical automotive air conditioner compressor operating conditions, the reference chamber pressure can be controllably changed, or tracked to a predetermined reference pressure, at the rate of 10 psi/second.

For alternative embodiments of VCV 10 without a pressure sensor, the compressor control unit 146 may periodically recalculate the compressor displacement conditions required to maintain performance of the cooling system. Based on the magnitude and time behavior of changes in these calculations, compressor control unit 146 may send instruction signals to VCV electronic control unit 82 to increase or decrease the reference chamber pressure to re-establish the pre-determined reference pressure level. It will be appreciated by those skilled in the art that this method of affecting servo control of the pressure in the reference chamber to the predetermined level will be less timely than can be implemented using a direct measurement of reference chamber pressure. Nonetheless, this loose-servo method can be effective and appropriate for a low cost embodiment of the present invention.

The functions attributed to VCV electronic control unit 82 and compressor control unit 146 could be performed by other computational resources within the overall system employing the VCV 10, compressor 100 and cooling equipment. For example, if the overall system is an automobile with a central processor, then all of the control information and calculations needed to select and maintain the predetermined reference pressure could be gathered and performed by the automobile central processor. Signals to and from pressure sensor 84 could be routed to an input/output (I/O) port of the central processor and reference inlet and outlet valve actuation signals could be sent to VCV 10 from another I/O port of the central processor. Alternately, a compressor control unit 146 could perform all the control functions needed to manage VCV 10. And finally, VCV control unit 82 could be provided with circuitry, memory and processor resources necessary to perform the compressor displacement requirement calculation as well as selecting and maintaining the predetermined reference pressure.

Figure 5:
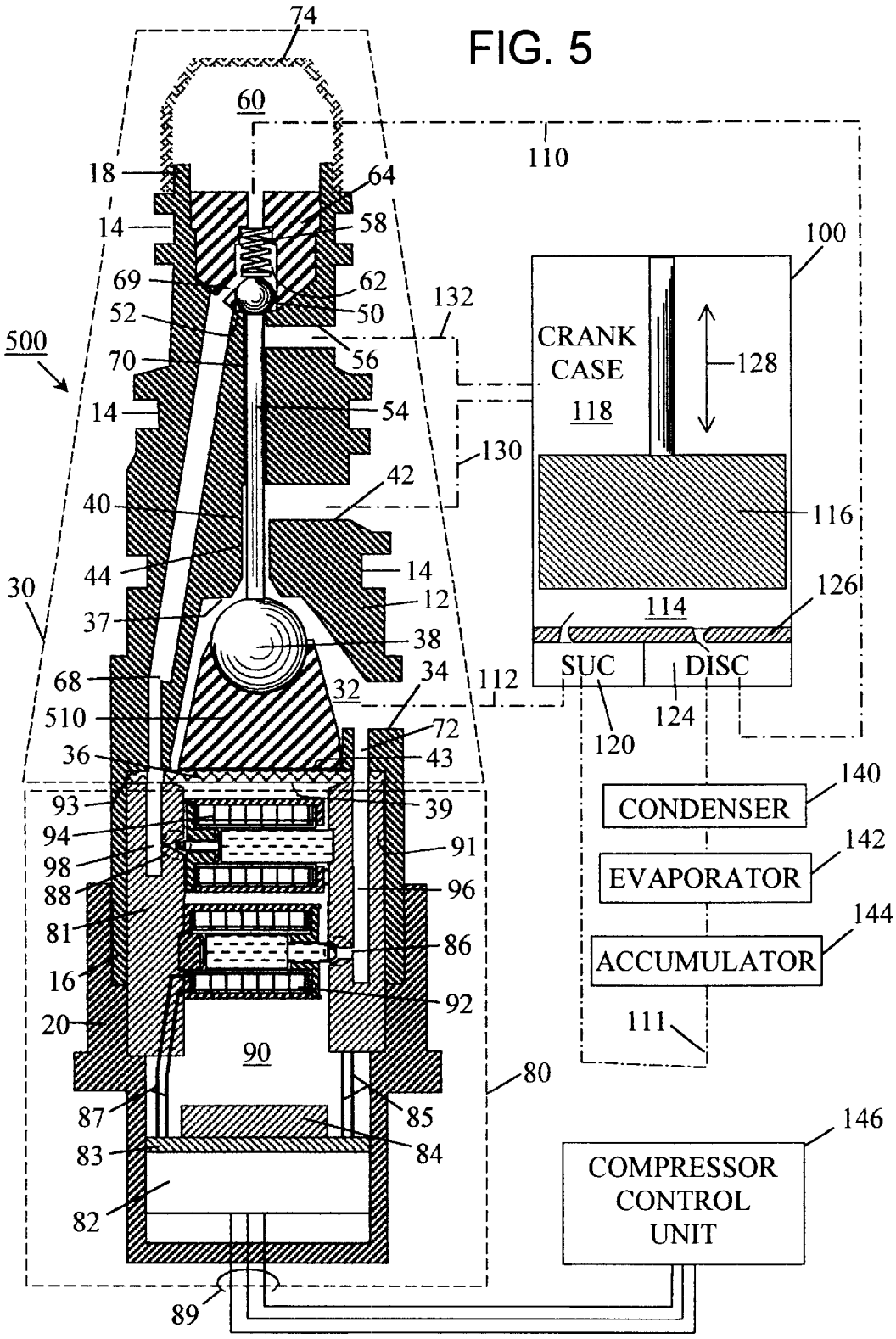
FIG. 5 shows a cross section of a variable set point control valve according to another embodiment of the present invention.

Another embodiment of the present invention is illustrated in FIG. 5. This embodiment is similar to the embodiment of FIG. 1 except that bias spring 44 is omitted and rigid member 41 is replaced with rigid alignment member 510. Rigid alignment member 510 is formed with a cavity that retains suction valve ball 38 by compression fit. Rigid alignment member 510 floats in the suction pressure chamber 32 and responds to the movement of diaphragm 36. In the embodiment of FIG. 5, VCV 500 operates in analogous fashion to VCV 10 in FIG. 1. The force exerted by bias spring 44 in FIG. 1 serves to push the suction valve portion farther open than would be achieved by simply reducing the reference pressure chamber all the way to suction pressure, fully retreating diaphragm 36. This bias spring force contribution is most important when opening the suction pressure valve portion of VCV 10 to rapidly reduce (dump) the pressure in the crankcase chamber 118 to increase compressor 100 capacity for rapid cooling.

In VCV 500 in FIG. 5 the suction valve ball 38 is nominally held in a maximum open condition by the set up of diaphragm 36 position, the dimensions of the rigid alignment member 510 and valve ball 38 assembly, and the position of suction valve seat 37. A higher predetermined reference pressure is needed to displace diaphragm 36 towards suction valve seat 37, to compensate for the maximum open set up. When maximum suction valve opening is needed to dump the crankcase chamber pressure, the predetermined reference pressure is reset back down to suction pressure, retreating diaphragm 36, and allowing the high pressure crankcase gas to push the suction valve portion to a maximum open condition.

Figure 6:
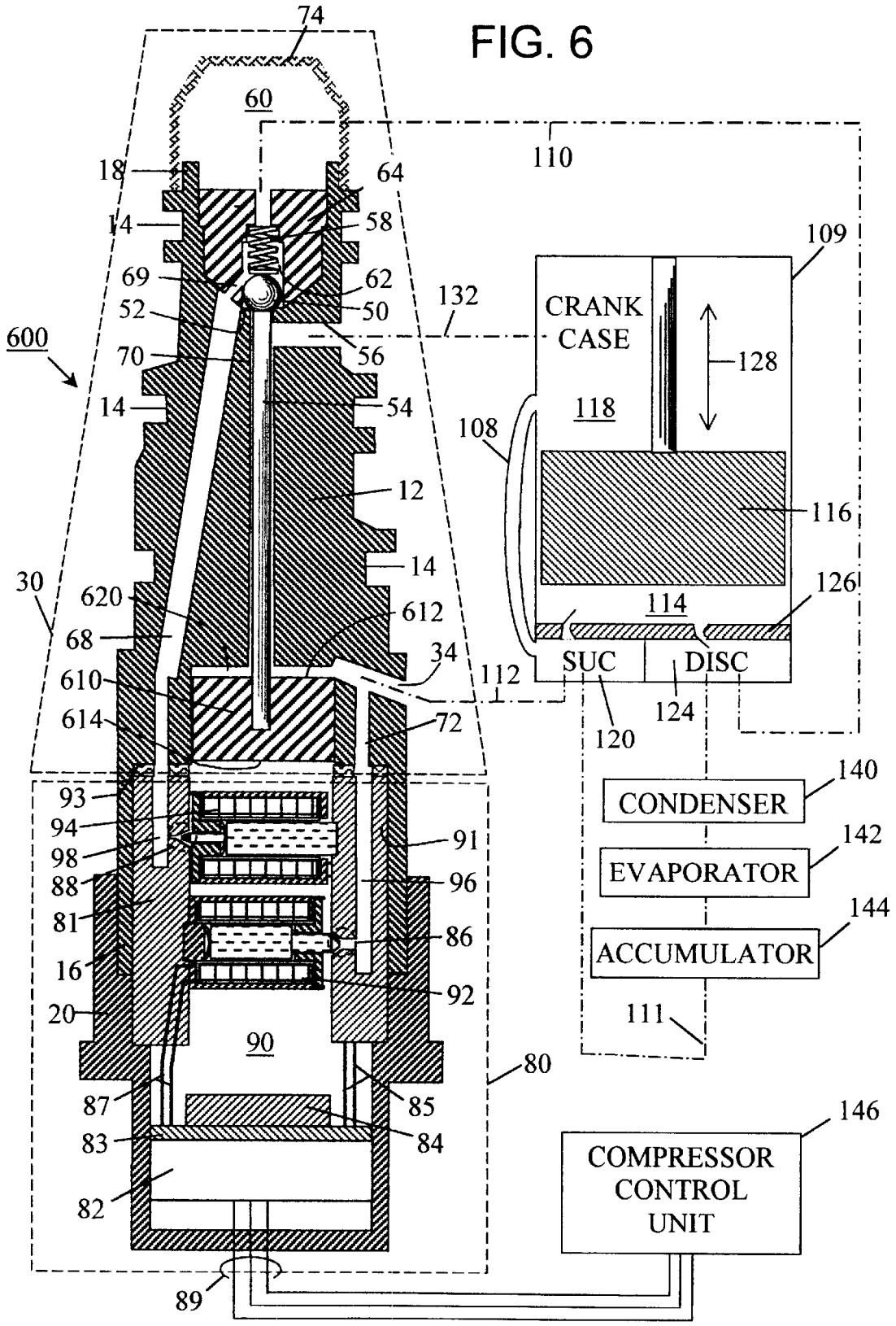
FIG. 6 shows a cross-section of a variable set point control valve according to yet another embodiment of the present invention

FIG. 6 illustrates another embodiment of the present invention. In this embodiment the compressor 109 has an internal bleed passageway 108 that allows gas to bleed from the crankcase chamber 118 to the suction area 120 of compressor 109. VCV 600 in FIG. 6 is similar to VCV 10 in FIG. 1 except that it omits the suction pressure valve portion. VCV 600 also uses a valve piston 610 as the pressure sensitive member instead of a diaphragm. Valve piston 610 has a suction pressure receiving area 612 and a reference pressure receiving area 614. Valve piston 610 moves in a suction pressure chamber 620. Valve piston 610 is operably coupled to the discharge pressure valve portion by valve rod 54. VCV 600 operates in analogous fashion to VCV 10 in FIG. 1 except that discharge gas will be supplied to the crankcase chamber 118 on a nearly continuous basis except when the compressor 109 must operate at maximum displacement and the crankcase pressure is maintained at suction pressure. The reference chamber pressure control algorithms will be different for VCV 600 than for VCV 10 in FIG. 1 due to some leakage of reference chamber gas to suction pressure chamber 620 via gaps between piston 610 and the walls of suction pressure chamber 620.

Figure 7:
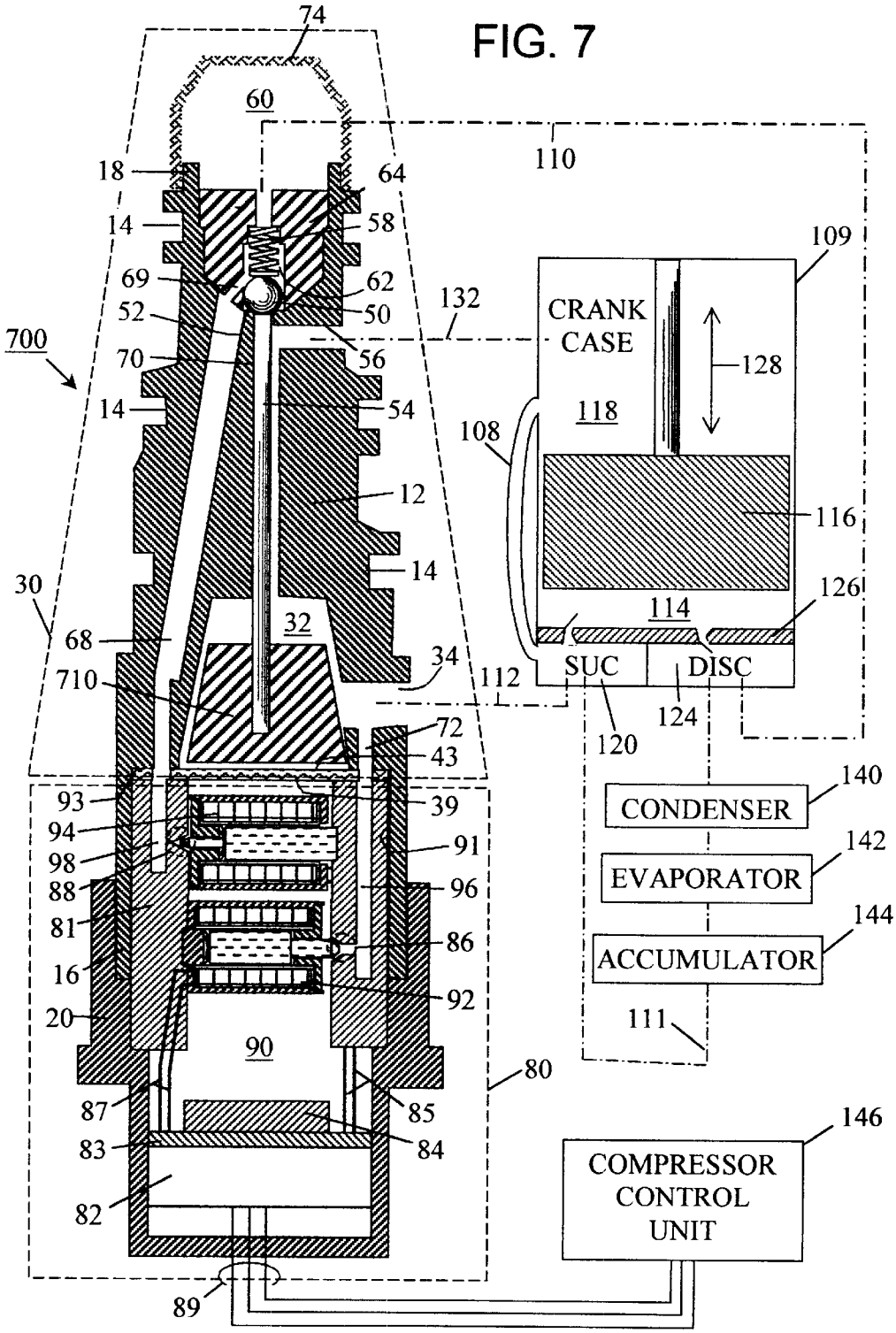
FIG. 7 shows a cross-section of a variable set point control valve according to a further embodiment of the present invention.

FIG. 7 illustrates another embodiment of the present invention. VCV 700 is configured to operate with compressor 109 having an internal bleed 108 between the crankcase chamber 118 and the suction area 120. It is similar to VCV 600 in FIG. 6 except that it uses a diaphragm 36 as a pressure sensitive member and rigid member 710 and valve rod 54 to operably couple the movement of diaphragm 36 to the discharge pressure valve portion VCV 700 operates in analogous fashion to VCV 600 in FIG. 6. The reference chamber pressure control algorithms used with VCV 700 are similar to those used with diaphragm-equipped VCV 500 and VCV 10 since there is no leakage of reference chamber gas to suction pressure outside the control of the reference chamber valve means.

Figure 8A:
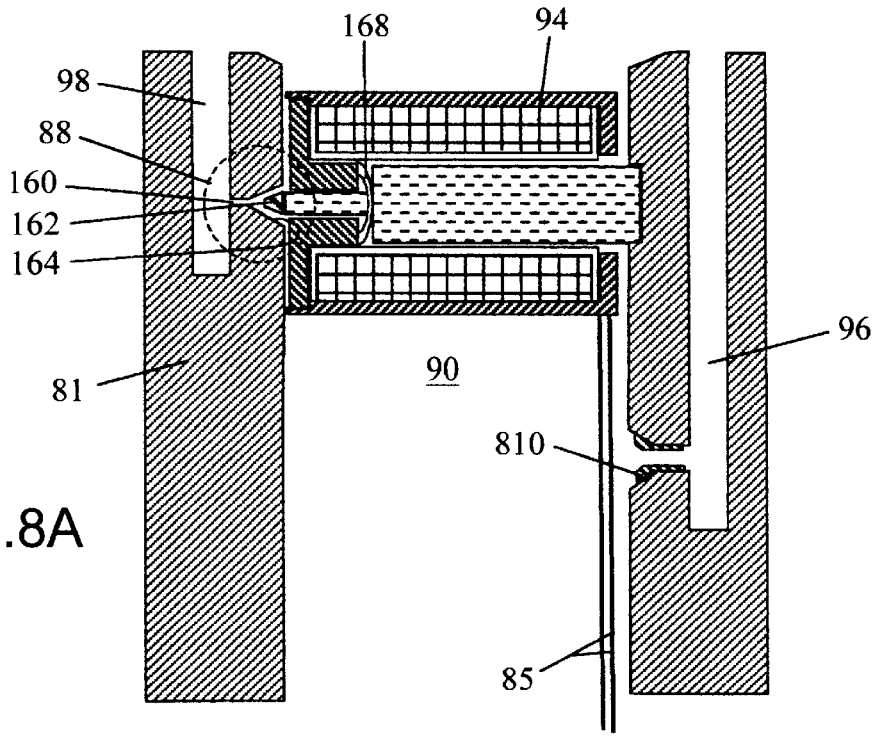
FIG. 8 shows cross-sections of two further embodiments of the reference chamber valve means that can be used with the variable control valves of FIGS. 1, 4, 5, and 6 of the present invention.
Figure 8B:
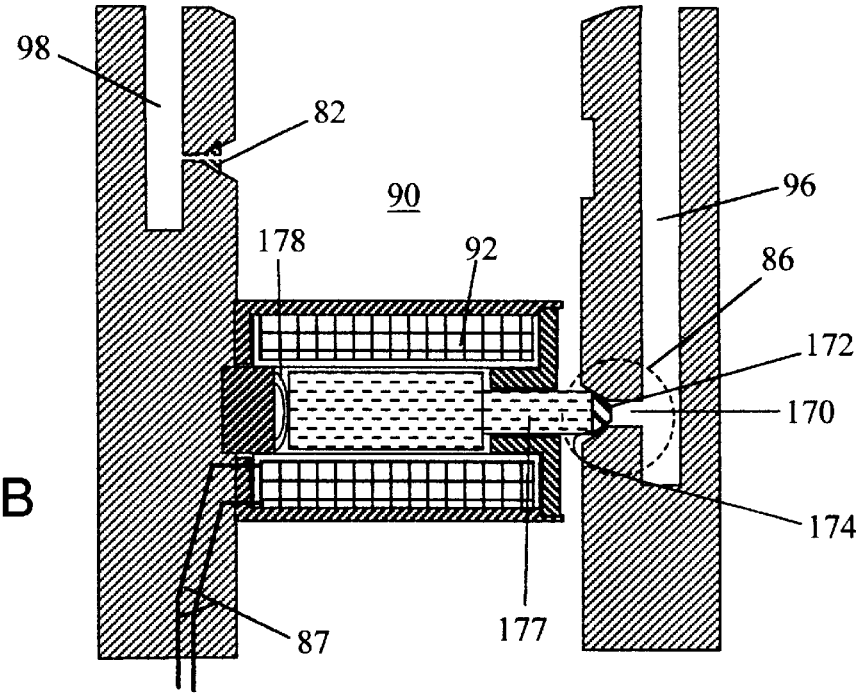

FIG. 8 illustrates two additional embodiments of the present invention. FIG. 8(*a*) shows an alternative embodiment of the reference chamber valve means illustrated in FIG. 3. The reference valve carrier 81 and inlet valve means 88 and inlet valve actuator 94 are unchanged. However in place of outlet valve means 86, a constant outlet bleed orifice 810 is provided. The predetermined reference pressure is set and maintained by actuating the reference inlet valve admitting discharge pressure gas. The reference pressure control algorithms used with this embodiment of the reference valve means are derived with cognizance of the characteristics of the constant bleed to suction pressure. With this arrangement a compromise must be struck between a desire to be able to rapidly change the predetermined reference pressure toward suction pressure, favoring a large bleed flow, and the controllability of higher predetermined reference pressure settings, favoring a small bleed flow.

FIG. 8(*b*) shows another alternative embodiment of the reference chamber valve means illustrated in FIG. 3. The reference valve carrier 81 and outlet valve means 86 and outlet valve actuator 92 are unchanged. However in place of inlet valve means 88, a constant inlet bleed orifice 820 is provided. The predetermined reference pressure is set and maintained by actuating the reference outlet valve, releasing reference chamber gas to suction bleed chamber 96. The reference pressure control algorithm used with this embodiment of the reference valve means are derived with cognizance of the characteristics of the constant bleed of discharge pressure into the reference chamber. With this arrangement a compromise must be struck between a desire to be able to rapidly change the predetermined reference pressure toward discharge pressure, favoring a large bleed flow, and the controllability of predetermined reference pressure settings that are near suction pressure, favoring a small bleed flow.

Either alternate embodiment of the reference chamber valve means disclosed in FIG. 8 may be substituted for the dual inlet and outlet reference valve arrangements depicted in FIGS. 1–7. That is, any of VCV embodiments VCV 10, VCV 500, VCV 600, or VCV 700 could be constructed with either of the single actuator reference valve means embodiments disclosed in FIG. 8.

Thus, a variable set point control valve is described which variably controls the displacement of a piston within a gas compression system by controlling a reference pressure acting upon a pressure sensitive member. Utilizing actuators which open and close based upon input from control algorithms within a control unit to control the flow of high or low pressure gas, the pressure acting upon the diaphragm can accurately adjust the degree of displacement of the piston. This variable fine tuning of the pressure against the diaphragm, hence the fine tuning of the piston displacement control, allows the compression system to operate at less than maximum capacity, thus substantially increasing the efficiency of the compression system.

The present examples and embodiments are to be considered as illustrative and not restrictive and the invention is not limited to the details given herein, but may be modified within the scope and equivalence of the appended claims.

What is claimed is:

1. A control valve in a variable displacement compressor having a piston having a displacement within a compression chamber, said compression chamber admitting a gas thereto from a suction area at a suction pressure and discharging the gas to a discharge area at a discharge pressure, a gas-filled crankcase chamber having a crankcase pressure acting upon the piston, the displacement of the piston varying according to the crankcase pressure, said control valve controlling the crankcase pressure, said control valve comprising:

a discharge pressure valve portion for opening or closing a gas communication path between the discharge area and the crankcase chamber;

a reference chamber isolated from the crankcase chamber having a reference pressure, said reference pressure established to a predetermined reference pressure by a flow of discharge and suction pressure gas to the reference chamber;

a pressure sensitive member having a suction pressure receiving area in gas communication with the suction pressure area and a reference pressure receiving area in gas communication with the reference chamber, said pressure sensitive member moving in response to the predetermined reference pressure and suction pressure changes;

means for operably coupling a movement of the pressure sensitive member to open the discharge valve portion; and reference chamber valve means for controlling the flow of at least one of discharge and suction pressure gas to the reference chamber in response to electrical signals, thereby establishing the predetermined reference pressure.

2. A control valve according to claim 1, further comprising a pressure sensor in gas communication with the reference chamber, wherein the pressure sensor produces an electrical signal related to the reference pressure.

3. A control valve according to claim 1, wherein the pressure sensitive member is a diaphragm having a first side in gas communication with the suction pressure area and a second side in gas communication with the reference pressure chamber.

4. A control valve according to claim 3, wherein the reference chamber is a closed space formed by rigid walls and the second side of the diaphragm.

5. A control valve according to claim 3, wherein the means for operably coupling the movement of the diaphragm comprises a rigid member in floating contact with the first side of the diaphragm.

6. A control valve according to claim 1, wherein the reference chamber valve means comprises a reference inlet actuator to control the flow of discharge pressure gas to the reference chamber and a reference outlet actuator to control the flow of suction pressure gas to the reference chamber.

7. A control valve according to claim 6, wherein the reference inlet actuator comprises a reference valve closing member having an effective inlet valve pressure receiving area of less than 30,000 square microns.

8. A control valve according to claim 6, wherein the reference inlet actuator comprises a reference inlet valve closing member, a reference inlet valve seat and an electromagnetic inlet solenoid to move the reference inlet valve closing member into sealing contact with the reference inlet valve seat.

9. A control valve according to claim 8, wherein the reference outlet actuator comprises a reference outlet valve closing member, a reference outlet valve seat, an electromagnetic inlet solenoid to move the reference outlet valve closing member into sealing contact with the reference outlet valve seat, and a reference valve carrier member for positioning and retaining the inlet and outlet electromagnetic solenoids in the reference chamber.

10. A control valve according to claim 6, wherein the reference chamber valve means further comprises a reference inlet port having an effective inlet diameter and a reference outlet port having an effective outlet diameter wherein the ratio of the effective outlet diameter to the effective inlet diameter is between 0.5 and 5.0.

11. A control valve according to claim 6, wherein the reference inlet actuator opens the flow of discharge pressure gas and the reference outlet actuator closes the flow of suction pressure gas in the absence of electrical signals.

12. A control valve in a variable displacement compressor having a piston having a displacement within a compression chamber, said compression chamber admitting a gas thereto from a suction area at a suction pressure and discharging the gas to a discharge area at a discharge pressure, a gas-filled crankcase chamber having a crankcase pressure acting upon the piston, the displacement of the piston varying according to the crankcase pressure, said control valve controlling the crankcase pressure, said control valve comprising:

a valve body;

a discharge pressure valve portion for opening or closing a gas communication path between the discharge area and the crankcase chamber;

a suction pressure valve portion for opening or closing a gas communication path between the suction area and the crankcase chamber;

a reference chamber having a reference pressure, said reference pressure established to a predetermined reference pressure by a flow of discharge and suction pressure gas to the reference chamber;

a diaphragm having a first side in gas communication with the suction pressure area and a second side in gas communication with the reference pressure chamber, said diaphragm moving in response to the predetermined reference pressure and suction pressure changes;

means for operably coupling a movement of the diaphragm to open the discharge valve portion and close the suction valve portion; and reference chamber valve means for controlling the flow of at least one of discharge and suction pressure gas to the reference chamber in response to electrical signals, thereby establishing the predetermined reference pressure.

13. A control valve according to claim 12, further comprising a pressure sensor in gas communication with the reference chamber, wherein the pressure sensor produces an electrical signal related to the reference pressure.

14. A control valve according to claim 12, wherein the means for operably coupling the movement of the diaphragm comprises a rigid alignment member in floating contact with the first side of the diaphragm, and wherein the suction pressure valve portion comprises a suction valve closing member attached to the rigid alignment member.

15. A control valve according to claim 12, wherein the diaphragm is moved in a direction in response to an increase in the suction pressure, said control valve further comprising spring bias means for urging the diaphragm in the same direction.

16. A control valve according to claim 15, wherein the spring bias means urges the diaphragm with a force equivalent to the force of a suction gas pressure of 2 to 20 psi.

17. A control valve according to claim 12, wherein the flow of discharge pressure gas to the reference chamber is communicated via a pathway within the valve body.

18. A control valve according to claim 12, wherein the reference chamber valve means comprises a reference inlet actuator to control the flow of discharge pressure gas to the reference chamber and a reference outlet actuator to control the flow of suction pressure gas to the reference chamber.

19. A control valve according to claim 18 wherein the reference inlet actuator comprises a reference inlet valve closing member having an inlet valve pressure receiving area of less than 30,000 square microns.

20. A method for controlling a variable displacement compressor having a piston having a displacement within a compression chamber, said compression chamber admitting a gas thereto from a suction area at a suction pressure and discharging the gas to a discharge area at a discharge pressure, a gas-filled crankcase chamber having a crankcase pressure acting upon the piston, the displacement of the piston varying according to the crankcase pressure, and a control valve having a gas-filled reference pressure chamber isolated from the crankcase chamber for controlling the crankcase pressure, said control method comprising:

determining an amount of gas to be compressed within the compression chamber by the piston to cause a condition to occur, determining a predetermined reference pressure within the reference pressure chamber to cause a crankcase pressure condition to occur;

measuring the reference pressure within the reference pressure chamber;

calculating an amount of discharge pressure gas flow into and suction pressure gas flow out of the reference pressure chamber based on the predetermined reference pressure and the measured reference pressure;

actuating at least one actuator to operate at least one reference chamber valve to cause the reference pressure to change towards the predetermined reference pressure by allowing the flow of discharge pressure and suction pressure gas into and out of the reference pressure chamber, moving a pressure sensitive member according to the pressure within the reference chamber, the pressure sensitive member opening a gas communication path between the discharge area and the crankcase chamber.

* * * * *